United States Patent [19]

Elbel

[11] Patent Number: 4,784,671

[45] Date of Patent: Nov. 15, 1988

[54] METHOD OF IMPROVING THE GRINDING PERFORMANCE OF GRINDING AND HONING BODIES

[76] Inventor: Karl Elbel, Gustav-Stresemannstrasse 100, D-7530 Pforzheim, Fed. Rep. of Germany

[21] Appl. No.: 164,468

[22] Filed: Mar. 4, 1988

[30] Foreign Application Priority Data

Mar. 6, 1987 [EP] European Pat. Off. ..... 87103236

[51] Int. Cl.[4] ..... B24D 3/00

[52] U.S. Cl. ..... 51/293; 51/296; 51/309

[58] Field of Search ..... 51/293, 296, 298, 309

[56] References Cited

U.S. PATENT DOCUMENTS

| | | | |
|---|---|---|---|
| 2,768,886 | 10/1956 | Twombly . | |
| 3,494,752 | 2/1970 | Daniel | 51/293 |
| 4,190,986 | 3/1980 | Kunimasa | 51/304 |
| 4,324,797 | 4/1982 | Suzuki . | |
| 4,541,843 | 9/1985 | Elbel et al. | 51/293 |
| 4,743,508 | 5/1988 | Masuda | 51/293 |

FOREIGN PATENT DOCUMENTS

| | | |
|---|---|---|
| 48464A/27 | 8/1978 | Japan . |
| 60-178066 | 9/1985 | Japan . |
| 84139747/22 | 1/1972 | U.S.S.R. . |
| 219679z | 7/1978 | U.S.S.R. . |

*Primary Examiner*—Theodore Morris
*Assistant Examiner*—Willie Thompson
*Attorney, Agent, or Firm*—Spencer & Frank

[57] ABSTRACT

A process for improving the grinding performance of a porous ceramic or plastic bound grinding or honing body, using the steps of obtaining a conventionally produced porous ceramic or plastic bound grinding or honing body, and filling the pore spaces of the body at least in part with at least one metal soap.

10 Claims, No Drawings

METHOD OF IMPROVING THE GRINDING PERFORMANCE OF GRINDING AND HONING BODIES

FIELD OF THE INVENTION

The present invention relates to a process for treating grinding and having wheels to improve their performance.

TECHNOLOGY REVIEW

Heat sensitive steels must be ground with reduced chip removal performance to avoid adverse changes in the structure of the material which would otherwise result from too much heat. The primary kinds of heat damage which should be avoided include deviations from the intended size, and also includes warping, burn traces and changes in structure, rehardening and new hardening, soft skin formation, unfavorable influence on internal stress, crack formation and chemical reactions.

If non-ferrous metals such as aluminum, brass, titanium and others are ground, difficulties arise with conventional grinding wheels because chips produced during grinding wedge in the surface of the wheel and are then welded again onto the ground workpiece surface. This can be avoided when grinding oil is used as a coolant and the wheels are dressed continuously. However, this leads to environmental problems (spent grinding oil is "waste oil") and corresponding disposal costs; additionally the consumption of grinding wheels increases due to the continuous dressing, thus further raising grinding costs.

There have been many attempts to at least partially overcome these problems. For example, for many decades, ceramic bound grinding and having bodies intended for certain tasks have been saturated with liquid sulfur, in the heat and usually in a vacuum, and have then been left to cool. The sulfur then acts as a high-pressure lubricant. However, this has the disadvantage that work with such sulfur-saturated grinding bodies causes chemical reactions to take place in the surface of the workpiece. Sulfur makes steel brittle and red-short and this can be very damaging, aside from the resulting environmental contamination with sulfur and its compounds.

Another way that was proposed is the addition of a coolant-lubricant by way of a hollow shaft into the grinding wheel bore and from there over the appropriately porous grinding wheel to the point of contact between wheel and workpiece. Here the circulating coolant must be cleaned with extreme care to prevent the pores of the grinding wheel from clogging (see Industrie-Anzeiger 53 [Industry Report], 1982, pages 39 et seq.)

SUMMARY OF THE INVENTION

We had previously found that grinding bodies produced, e.g., according to the process of European Pat. No. 0,114,280, which corresponds to U.S. Pat. No. 4,541,843, have improved grinding characteristics when a metal soap is added during the manufacturing process. Thus, tempered and hardened steels can be ground faster and cooler with such specially manufactured wheels which already contain metal soap than with conventional grinding wheels. When grinding aluminum, titanium, plastics and similar materials, the pores of the specially manufactured grinding or having bodies containing such metal soap do not clog up so that the feared rewelding and sheet metal jacket formations are avoided. Burr formation is also suppressed considerably, if not completely avoided.

It is an object of the present invention to realize the advantageous grinding behavior of the specially manufactured grinding wheels even with conventionally produced grinding or having bodies, thus avoiding the problems discussed above.

This is accomplished according to the present invention by filling the conventionally produced porous grinding or having body at least in part with a metal soap. The term "metal soaps" as used in this application means neutral or basic salts of monovalent or multivalent metals or amines. The term "conventionally produced" porous grinding or having body refers to one not made in accordance with the process of U.S. Pat. No. 4,541,843.

DESCRIPTION OF THE PREFERRED EMBODIMENTS

Advantageously, finish fired, ceramic bound wheels having a relatively large pore volume, primarily a structure of 7 or larger, are treated with metal soaps until the volume of the metal soaps introduced corresponds at least to 5% of the total volume of the grinding wheel. The same applies correspondingly for plastic bound grinding bodies insofar as they have the corresponding structure.

Advantageously, soaps are employed which, on the one hand, are compatible with the environment and with coolants and which, on the other hand, have the highest possible melting point. This includes primarily the salts and soaps of the following fatty acids, (whose melting point (M) is also given):

| Name | Formula | M |
|---|---|---|
| lauric acid | $C_{11}H_{23}$—COOH | 43° C. |
| myristic acid | $C_{13}H_{27}$—COOH | 54° C. |
| palmitic acid | $C_{15}H_{31}$—COOH | 63° C. |
| stearic acid | $C_{17}H_{35}$—COOH | 72° C. |
| arachic acid | $C_{19}H_{39}$—COOH | 75° C. |
| behenic acid | $C_{21}H_{43}$—COOH | 80° C. |

as salts of calcium, zinc, aluminum, sodium or lithium.

Montanic acids $C_{22}$ . . . to $C_{34}$ having melting points higher than 80° C. can also be employed as fatty acids, and also hydroxy compounds of the listed compounds, such as, for example, 12-oxystearic acid.

There are various ways to introduce such metal soaps into the grinding bodies; these will be described individually below with reference to examples.

For example, sodium or lithium soaps can be dissolved in hot water. The grinding wheel can be saturated with such solutions, possibly in a vacuum. The wheel should then also be heated (about 90° C.) to prevent premature gelling of the solution. After the solution has gelled due to cooling, the water must be removed, which is best done by freeze-drying. This process step may be followed by a further saturation with subsequent drying to introduce the desired quantity of soap into the wheel body.

This saturation process is possible in an analogous manner also with corresponding organic solvents. In both cases, it may be advisable to add small quantities of a binder: in the case of aqueous solutions, for example, polyvinyl alcohol; in the case of organic solvents, for example polyvinyl acetate, cellulose acetate or the like, to fix the soaps, which are precipitated in the form of a powder, in the pores of the wheels.

A further possibility of introducing such soaps into correspondingly porous grinding wheel bodies is to form the soap in the grinding or having wheel by chemical reaction. This has the advantage that only small quantities of water form which must be removed and that the soaps are obtained in a compact form, and a single saturation process may be sufficient. Moreover, the addition of small quantities of binders can be omitted.

For example, stearic acid is melted, the stoichiometric quantity of zinc oxide is dispersed therein and then the heated wheel is saturated with the mixture, possibly in a vacuum, and is heated further until the following reaction takes place:

$$2C_{17}H_{35}—COOH+ZnO=(C_{17}H_{35}—COO)_2Zn+H_2O$$

and the water from the reaction is removed. Instead of metal oxides, the corresponding metal hydroxides or metal carbonates or an amine may also be used so that then, for example, the following reactions take place to form the metal soap in the grinding body:

$$2C_{17}H_{35}—COOH+Na_2CO_3=2C_{17}H_{35}—COONa+CO_2+H_2O$$

$$C_{17}H_{35}—COOH+NaOH=C_{17}H_{35}—COONa+H_2O$$

$$2C_{17}H_{35}—COOH+H_2N—C_2H_4NH_2=(C_{17}H_{35}—COO)_2—C_2H_4—NH_2+2H_2O$$

A further possibility for forming the metal soaps according to the invention by chemical reaction in the grinding and having bodies is to start with a corresponding melt of an ammonium soap to which is added the stoichiometric quantity of the corresponding metal oxide or metal hydroxide, respectively. After saturation, the water and ammonia developed during the reaction to form the metal soap are driven out.

EXAMPLE $$C_{17}H_{35}—COONH_4+LiOH=C_{17}H_{35}—COOLi+NH_3+H_2O$$

The present disclosure relates to the subject matter disclosed in European Patent Application No. EP 77103236.3 on Mar. 6, 1987, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. A process for improving the grinding performance of a porous ceramic or plastic bound grinding or having body, comprising the steps of obtaining a conventionally produced porous ceramic or plastic bound grinding or having body, and filling the pore spaces of the bvody at least in part with at least one metal soap.

2. A process as defined in claim 1, wherein the soap comprises a metal ion selected from the group consisting of ions of lithium, sodium, potassium, magnesium, and calcium.

3. A process as defined in claim 1, wherein the metal soap comprises a salt of at least one of the group consisting of stearic acid, hydroxystearic acid and palmitic acid.

4. A process as defined in claim 1, wherein the volume percentage of the introduced metal soaps is at least 5% of the entire volume of the grinding body.

5. A process as defined in claim 1 to 4, wherein the introduction of the metal soaps into the pore spaces is effected by saturation of the grinding or having body with an aqueous or organic solution of the metal soaps and the solvent is then removed.

6. A process according to claim 1, comprising the further steps of mixing precursors of the metal soap with one another; liquifying the resulting mixture by heating to form a reaction mixture for the formation of one of the desired metal soaps; introducing the reaction mixture into the pore spaces of the body in a vacuum; heating the body so that a reaction takes place to form the metal soap; and driving out the reaction byproducts.

7. A process as defined in claim 6, wherein the reaction mixture is composed of a fatty acid ($C_nH_{2n+1}$—COOH), with $n \geqq 11$, and a metal compound.

8. A process as defined in claim 6, wherein the fatty acid is stearic acid and the metal compound is sodium hydroxide; and heating is effected to above 71° C., whereupon, after introduction into the pore spaces, sodium stearate and water form according to the following reaction equation:

$$C_{17}H_{35}—COOH+NaOH=C_{17}H_{35}—COONa+H_2O.$$

9. A process as defined in claim 6, wherein the introduction of the metal soap into the pore spaces is effected by producing a melt of ammonium soap; adding thereto the stoichiometric quantity of a metal oxide or hydroxide to form a mixture; saturating the grinding or having body with the mixture and allowing the mixture to react to form the metal soap; and driving out the water and ammonia formed by the reaction.

10. A process as defined in claim 9, wherein the ammonium soap is $C_{17}H_{35}$—$COONH_4$ and the metal hydroxide is LiOH, thus producing the following reaction:

$$C_{17}H_{35}—COONH_4+LiO \rightarrow C_{17}H_{35}—COOLi+NH_3+H_2O.$$

* * * * *